US010472950B2

(12) United States Patent
Dewald

(10) Patent No.: US 10,472,950 B2
(45) Date of Patent: Nov. 12, 2019

(54) PLUG DETECTION SYSTEM AND METHOD

(71) Applicant: Nabors Drilling Technologies USA, Inc., Houston, TX (US)

(72) Inventor: Brian Dale Dewald, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 168 days.

(21) Appl. No.: 15/713,127

(22) Filed: Sep. 22, 2017

(65) Prior Publication Data

US 2019/0093472 A1 Mar. 28, 2019

(51) Int. Cl.

| | |
|---|---|
| ***E21B 33/16*** | (2006.01) |
| ***E21B 47/06*** | (2012.01) |
| ***E21B 37/02*** | (2006.01) |

(52) U.S. Cl.

CPC ..... *E21B 47/06* (2013.01); *E21B 33/16* (2013.01); *E21B 37/02* (2013.01)

(58) Field of Classification Search

CPC ..... E21B 47/06; E21B 47/09; E21B 37/02; E21B 33/05; E21B 33/13; E21B 33/14–16

See application file for complete search history.

(56) References Cited

U.S. PATENT DOCUMENTS

| | | | | |
|---|---|---|---|---|
| 2016/0230533 | A1* | 8/2016 | Steele | E21B 33/16 |
| 2016/0362938 | A1* | 12/2016 | Gan | E21B 10/36 |
| 2017/0138177 | A1* | 5/2017 | Hazel | E21B 47/01 |

* cited by examiner

*Primary Examiner* — George S Gray

(74) *Attorney, Agent, or Firm* — Enrique Abarca; Abel Schillinger, LLP

(57) ABSTRACT

A system that can include a first sensor disposed within a tubular and configured to monitor a pressure within the tubular, a second sensor disposed within the tubular downstream of the first sensor and configured to monitor the pressure within the tubular, and a controller. The controller being configured to detect a launch of the cement plug when the first sensor detects a first pressure drop and when the second sensor detects a second pressure drop, where the second pressure drop occurs after the first pressure drop within a predetermined elapsed time range.

20 Claims, 4 Drawing Sheets

PLUG DETECTION SYSTEM AND METHOD

BACKGROUND

Embodiments of the present disclosure relate generally to the field of drilling and processing of wells. More particularly, present embodiments relate to a system and method for detecting and/or tracking a cement plug during casing operations.

Cement plugs are typically utilized during casing operations to substantially remove cement from an interior surface of wellbore tubulars. In conventional oil and gas operations, an annulus is formed around the wellbore tubulars within a formation. During completion operations, casing (e.g., wellbore tubulars) may be secured to the formation via cementing. The cement is pumped through the casing to fill the annulus and secure the casing to the formation. After cement pumping is complete, the cement plug is introduced into the casing to clear the cement from the interior surface of the casing. As a result, cementing operations may continue with little to no mixing of cement with the drilling and/or displacement fluids pumped through the casing.

BRIEF DESCRIPTION

In accordance with one aspect of the disclosure a system includes a system that includes a cement plug and a sensor system. The sensor system includes a first sensor disposed within a tubular and configured to monitor a pressure within the tubular, a second sensor disposed within the tubular downstream of the first sensor with respect to a flow of fluid through the tubular, where the second sensor is configured to monitor the pressure within the tubular, and a controller configured to detect a launch of the cement plug when the first sensor detects a first pressure drop and when the second sensor detects a second pressure drop, where the second pressure drop occurs after the first pressure drop within a predetermined elapsed time range.

In accordance with another aspect of the disclosure, a drilling rig includes a casing string configured to receive and direct drilling fluids from a rig floor to a wellbore, a cement swivel configured to supply cement into the casing string to secure the casing string in the wellbore, a cement plug configured to remove cement from within the casing string, and a sensor system. The sensor system includes a first sensor disposed within the casing string and configured to monitor a pressure within the casing string, a second sensor disposed within the casing string downstream of the first sensor with respect to a flow of drilling fluid through the casing string, where the second sensor is configured to monitor the pressure within the casing string, and a controller configured to detect a launch of the cement plug when the first sensor detects a first pressure drop and when the second sensor detects a second pressure drop, where the second pressure drop occurs after the first pressure drop within a predetermined elapsed time range.

In accordance with another aspect of the disclosure, a method includes receiving feedback from a first sensor disposed in a casing string and a second sensor disposed in the casing string, where the second sensor is positioned downstream of the first sensor with respect to a flow of fluid within the casing string, detecting a first pressure drop from the first sensor, detecting a second pressure drop from the second sensor, and determining a launch of a cement plug in the casing string when the first pressure drop and the second pressure drop occur within a predetermined elapsed time range.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
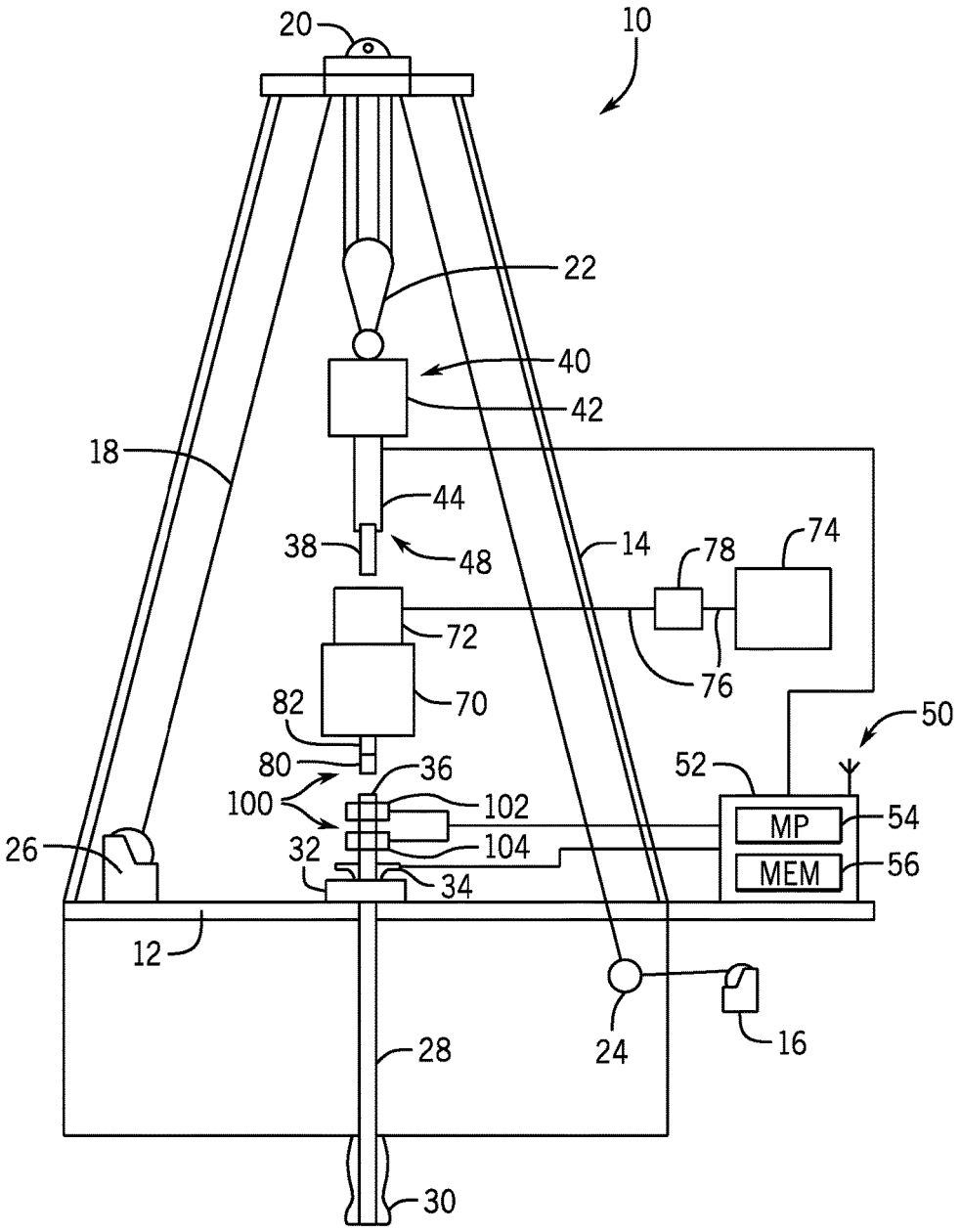
FIG. 1 is a schematic of an embodiment of a well being drilled with a plug tracking system, in accordance with an aspect of the present disclosure.

Present embodiments provide a system and method for detecting a launch of a cement plug within a casing or other tubular. For example, during casing cementing operations, a plug (e.g., rubber plug) is used to separate cement from displacement fluid as the plug is launched to substantially remove cement from an interior surface of wellbore tubulars (e.g., casing). In certain embodiments, the plug includes a port to allow cement to pass through the plug and into the casing or tubular. After a desired amount of cement is pumped into the casing or tubular, a solid ball is launched to occlude the port of the plug. Thereafter, displacement fluid (e.g., water or a water mixture) is pumped behind the ball and plug, thereby creating pressure and causing the plug to be launched down the casing or tubular. Unfortunately, the plug is not visible within the casing or tubular, thereby creating difficulty in ascertaining whether the plug is properly positioned within the tubular or casing and/or whether the plug has properly been launched down the casing. Existing plug detection systems utilize magnets, which may affect operation of components (e.g., sensors) of a drilling rig and/or a wellbore. Thus, present embodiments are directed to an improved system and method for detecting the launch of the plug within the casing or tubular.

As discussed in detail below, a plug detection system includes a first sensor (e.g., a first pressure sensor) and a second sensor (e.g., a second pressure sensor) positioned on or within the casing or tubular to detect a pressure drop that occurs as the plug travels over and/or past the first sensor and the second sensor. For example, first and second sensors may be disposed in openings in the casing or tubular and secured in the openings using threads, an adhesive, a sealant, a fastener (e.g., belts, straps, clamps, or other bands), and/or another suitable securement device. Once the first and second sensors are disposed in the openings, the openings may be sealed, such that fluid (e.g., cement, water, or a water mixture) may be blocked from exiting the casing or tubular through the openings.

Before the cementing process is completed, the plug (e.g., annular plug) is positioned or "stabbed" into the casing or tubular. The ball to block the port of the plug is launched to block the port of the plug, and displacement fluid is then pumped into the casing above the plug. Once the plug is launched down the casing by the displacement fluid, the first and second sensors each detect a pressure drop as the plug travels through the casing past the sensors. The pressure drop measured by the first and second sensors may be detected by a controller, which may provide an indication to a user or operator confirming a positive launch of the plug. In some embodiments, a distance between the first and second pressure sensors may be greater than a length of the plug, such that the pressure drop detected by the first sensor occurs prior to the pressure drop detected by the second sensor. Accordingly, the user or operator may confirm that the plug has launched when the first sensor measures a first pressure drop and the second sensor detects a second pressure drop that occurs within a predetermined elapsed time range after the first pressure drop.

Turning now to the drawings, FIG. 1 is a schematic view of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a casing string 28 extends downward into a wellbore 30 and is held stationary with respect to the rig floor 12 by a rotary table 32 and slips 34 (e.g., power slips). A portion of the casing string 28 extends above the rig floor 12, forming a stump 36 to which another length of tubular 38 (e.g., a section of casing) may be added.

A tubular drive system 40, hoisted by the traveling block 22, positions the tubular 38 above the wellbore 30. In the illustrated embodiment, the tubular drive system 40 includes a top drive 42 and a gripping device 44. The gripping device 44 of the tubular drive system 40 is engaged with a distal end 48 (e.g., box end) of the tubular 38. The tubular drive system 40, once coupled with the tubular 38, may then lower the coupled tubular 38 toward the stump 36 and rotate the tubular 38 such that it connects with the stump 36 and becomes part of the casing string 28. The casing string 28 (and the tubular 38 now coupled to the casing string 28) may then be lowered (and rotated) further into the wellbore 30.

The drilling rig 10 further includes a control system 50, which is configured to control the various systems and components of the drilling rig 10 that grip, lift, release, and support the tubular 38 and the casing string 28 during a casing running or tripping operation. For example, the control system 50 may control operation of the gripping device 44 and the power slips 34 based on measured feedback to ensure that the tubular 38 and the casing string 28 are adequately gripped and supported by the gripping device 44 and/or the power slips 34 during a casing running operation. In this manner, the control system 50 may reduce and/or eliminate incidents where lengths of tubular 38 and/or the casing string 28 are unsupported. Moreover, the control system 50 may control auxiliary equipment such as mud pumps, robotic pipe handlers, and the like.

In the illustrated embodiment, the control system 50 includes a controller 52 having one or more microprocessors 54 and a memory 56. For example, the controller 52 may be an automation controller, which may include a programmable logic controller (PLC). The memory 56 is a non-transitory (not merely a signal), tangible, computer-readable media, which may include executable instructions that may be executed by the microprocessor 54. The controller 52 receives feedback from other components and/or sensors that detect measured feedback associated with operation of the drilling rig 10. For example, the controller 52 may receive feedback from a plug detection system described below and/or other sensors via wired or wireless transmission. Based on the measured feedback, the controller 52 may regulate operation of the tubular drive system 40 (e.g., increasing rotation speed).

In the illustrated embodiment, the drilling rig 10 also includes a casing drive system 70. The casing drive system 70 is configured to reciprocate and/or rotate the tubular 38 (e.g., casing) during casing and/or cementing operations. In the illustrated embodiment, the casing drive system 70 is placed above the rig floor 12. However, in other embodiments the casing drive system 70 may be placed beneath the rig floor 12, at the rig floor 12, within the wellbore 30, or any other suitable location on the drilling rig 10 to enable rotation of the tubular 38 during casing and/or cementing operations. As mentioned above, in certain embodiments, the control system 50 may control the operation of the casing drive system 70. For example, the control system 50 may increase or decrease the speed of rotation of the tubulars 38 based on wellbore conditions.

The casing drive system 70 may be used during cementing operations to direct cement into the casing string 28. In the illustrated embodiment, the casing drive system 70 is coupled to a cement swivel 72 configured to supply cement for cementing operations. For example, the cement swivel 72 may receive cement from a pumping unit 74 via a supply line 76. Additionally, the casing drive system 70 may include an inner bore configured to direct the cement through the casing drive system 70 and into the casing string 28.

Furthermore, a plug 80 coupled to a casing drive system adapter 82 may be positioned within (e.g., "stabbed" into) the casing string 28. As mentioned above, the plug 80 may include a port or central passage that enables cement to flow from the casing drive system 70, through the plug 80, and into the casing 28. After the casing cementing process is completed, the plug 80 is used to substantially remove cement from an interior surface of the casing string 28. To this end, a ball launcher 78 positioned in the supply line 76 between the cement swivel 72 and the pumping unit 74 is configured to launch a ball through the casing drive system 70 to the plug 80. The ball occludes the port or central passage of the plug 80 to block fluid from passing across the plug 80. Once the ball is launched from the ball launcher 78 to block the port of the plug 80, a displacement fluid (e.g., water, a water mixture, and/or a chemical substance) is pumped behind the ball and plug 80, which causes the plug 80 to be launched down the casing string 28. As the plug 80 travels down the casing string 28, the plug 80 cleans and/or removes cement from the inner surface of the casing string 28.

As mentioned above, embodiments of the present disclosure are directed to a plug detection system 100 configured to detect a position and/or movement of the plug 80. The plug detection system 100 includes a first sensor 102 (e.g., a first pressure sensor) and a second sensor 104 (e.g., a second pressure sensor) disposed on or within the casing string 28 at the rig floor 12. In other embodiments, the plug detection system 100 having the first sensor 102 and the second sensor 104 is disposed at another suitable location above the rig floor 12 or below the rig floor 12. For example, the first and second sensors 102 and 104 are be disposed in openings (e.g., threaded openings) of the casing string 28 and secured in the openings using threads, an adhesive, a sealant, a fastener (e.g., belts, straps, clamps, or other bands), and/or another suitable securement device. Once the first and second sensors 102 and 104 are disposed in the openings, the openings may be sealed, such that fluid (e.g., cement, water, or a water mixture) may be blocked from exiting the casing or tubular through the openings.

In some embodiments, a distance between the first and second sensors 102 and 104 is greater than a height of the plug 80, such that the pressure drop detected by the first sensor 102 occurs prior to the pressure drop detected by the second sensor 104. Accordingly, the user or operator may confirm that the plug 80 has launched when the first sensor 104 measures a first pressure drop and the second sensor 104 measures a second pressure drop that occurs within a predetermined elapsed time range after the first pressure drop. Further, the first and second sensors 102 and 104 are positioned below the plug 80, such that both the first and second sensors 102 and 104 measure a pressure drop as the plug 80 travels past the first and second sensors 102 and 104. As shown in the illustrated embodiment of FIG. 1, the first sensor 102 and the second sensor 104 are coupled to the controller 52, such that the first sensor 102 and the second sensor 104 provide feedback indicative of pressure within the casing string 28 to the controller 52.

It should be noted that the illustration of FIG. 1 is intentionally simplified to focus on the plug detection system 100 of the drilling rig 10, which is described in greater detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform. Furthermore, it will be appreciated that the disclosed detection system may have other applications where detecting movement of components within enclosed vessels or containers may be useful. For example, the presently disclosed embodiments may be useful for detecting the passage of a pipeline inspection gauge traveling inside an enclosed pipe. While only certain features of the disclosure have been illustrated and described herein, many modifications and changes will occur to those skilled in the art. It is, therefore, to be understood that the appended claims are intended to cover all such modifications and changes as fall within the true spirit of the disclosure.

Figure 2:
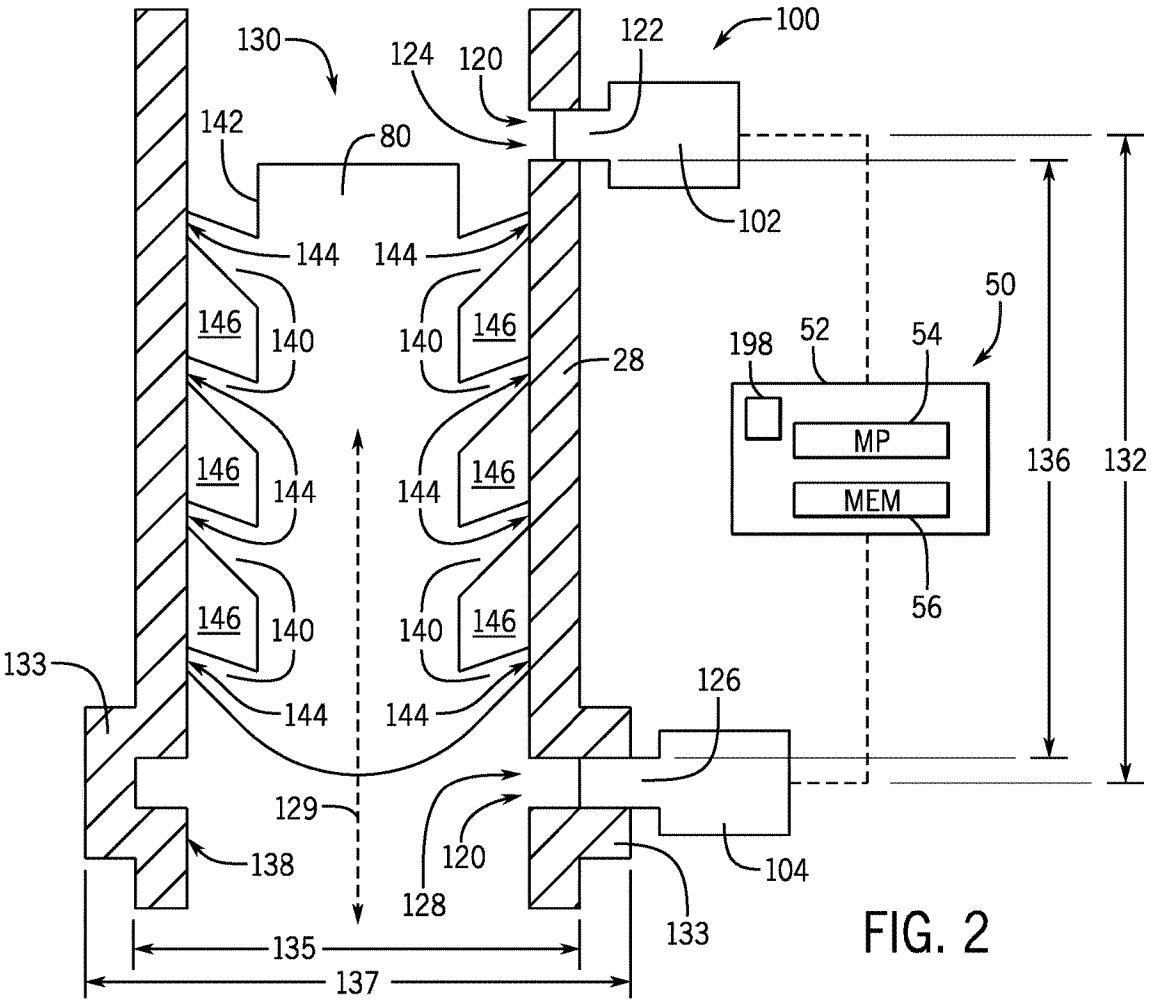
FIG. 2 is a cross-section schematic of an embodiment of the plug tracking system of FIG. 1, in accordance with an aspect of the present disclosure.

FIG. 2 is a cross section schematic of an embodiment of the plug detection system 100. As shown in the illustrated embodiment of FIG. 2, the plug 80 is disposed in the casing string 28 (e.g., an annular tubular). The casing string 28 includes openings 120 (e.g., threaded apertures) configured to receive the first sensor 102 and the second sensor 104. For example, the first sensor 102 may include a first threaded sensing portion 122 that engages with corresponding threads of a first opening 124 of the openings 120. Additionally, the second sensor 104 may include a second threaded sensing portion 126 that engages with corresponding threads of a second opening 128 of the openings 120. While the illustrated embodiment of FIG. 2 shows the plug detection system 100 having two sensors 102 and 104 disposed in two openings 124 and 128, in other embodiments, the plug detection system 100 may include more than two sensors (e.g., three, four, five, six, seven, eight, nine, ten, or more sensors) that are disposed in a corresponding number of openings 120. For example, additional sensors may be aligned with the first sensor 102 and/or the second sensor 104 along an axis 129 in which the casing string 28 extends, such that the additional sensors verify measurements of the first sensor 102 and/or the second sensor 104.

In some embodiments, the openings 120 are sealed once the first sensor 102 and the second sensor 104 are disposed in the openings 120. In some embodiments, the openings 120 are sealed using welding, a sealing component (e.g., an o-ring), a silicone sealant, an epoxy sealant, and/or another suitable sealant. Sealing the openings 120 blocks fluid within the casing string 28 from leaking and/or otherwise flowing out of a passageway 130 of the casing string 28.

The first sensor 102 and the second sensor 104 are configured to detect a pressure in the passageway 130 of the casing string 28. For example, the first sensor 102 and the second sensor 104 may be pressure transducers that measure pressure within the casing string 28. In some embodiments, the first sensor 102 and the second sensor 104 are battery powered. In other embodiments, the first sensor 102 and the second sensor 104 are configured to receive power from the controller 52. In any case, the first sensor 102 and the second sensor 104 are communicatively coupled to the controller 52 of the control system 50, such that the first sensor 102 and the second sensor 104 provide feedback to the controller 52 indicative of the pressure within the passageway 130 of the casing string 28. The feedback received from the first sensor 102 and the second sensor 104 may enable the controller 52 to determine a flow rate of fluid (e.g., cement, water, a water mixture, and/or another chemical) through the passageway 130. For example, when the first sensor 102 and the second sensor 104 provide feedback indicative of a pressure drop experienced within the passageway 130 at approximately the same time (e.g., within 10 milliseconds, within 50 milliseconds or within 100 milliseconds), the controller 52 may determine that the flow of fluid in the passageway 130 has decreased and/or stopped. Additionally, the first sensor 102 and the second sensor 104 may enable the controller 52 to determine pulsing of the flow of fluid resulting from a pump that drives the flow of fluid through the passageway 130. For example, the first sensor 102 and the second sensor 104 may each provide feedback that includes a fluctuating pressure profile. The fluctuating pressure profiles of both the first sensor 102 and the second sensor 104 may substantially mirror one another, such that pressure fluctuations occur at approximately the same time as one another (e.g., within 10 milliseconds, within 50 milliseconds, or within 100 milliseconds).

As discussed above, the first sensor 102 and the second sensor 104 may be utilized to determine whether the plug 80 launches into the casing string 28. As shown in the illustrated embodiment of FIG. 2, the first sensor 102 and the second sensor 104 are spaced a distance 132 apart from one another relative to the axis 129 along which the casing string 28 extends. The distance 132 between the first sensor 102 and the second sensor 104 is greater than a length 136 of the plug 80. As such, the first sensor 102 experiences a pressure drop before the second sensor 104 when the plug 80 launches and moves through the casing string 28. Therefore, the controller 52 receives feedback from the first sensor 102 and the second sensor 104 that includes a sequential pressure drop occurring at the first sensor 102 and then the second sensor 104. Accordingly, the controller 52 may detect that the plug 80 has launched when a time between a first pressure drop measured by the first sensor 102 and a second pressure drop measured by the second sensor 104 is within a predetermined elapsed time range. For example, the predetermined elapsed time range may be between 250 milliseconds and 10 seconds, between 500 milliseconds and 5 seconds, or between 750 milliseconds and 2 seconds. Thus, when the controller 52 receives feedback that includes a sequential pressure drop between the first sensor 102 and the second sensor 104 within the predetermined elapsed time range, the controller 52 may determine that the plug 80 launched.

In some embodiments, the first sensor 102 and/or the second sensor 104 may be disposed in an extension portion 133 of the casing string 28. For example, the extension portion 133 may be a portion of the casing string 28 that includes an outer diameter 137 that is greater than an outer diameter 135 of the remainder of the casing string 28. Disposing the first sensor 102 and/or the second sensor 104 in the extension portion 133 of the casing string 28 may enable the plug detection system 100 to monitor a flow rate of the fluid flowing through the casing string 28. For example, the extension portion 133 may enable the first sensor 102 and/or the second sensor 104 to detect a pressure differential of the fluid flowing through the casing string 28, and thus determine a flow rate of the fluid. The fluid flowing through the casing string 28 may flow within the extension portion to enable the first sensor 102 and/or the second sensor 104 to detect a pressure differential of the fluid over a predetermined period of time. Thus, the controller 52 may calculate a flow rate of the fluid based on the pressure differential detected by the first sensor 102 and/or the second sensor 104. While the illustrated embodiment of FIG. 2 shows the second sensor 104 disposed in the extension portion 133, in other embodiments, the first sensor 102 may be disposed in the extension portion 133 to monitor a flow rate of the fluid through the casing string 28. In still further embodiments, the casing string 28 may not include the extension portion 133.

Further, the illustrated embodiment of FIG. 2 shows a configuration of the plug 80. To enable cement clearing along an inner wall 138 (e.g., a wall of the passageway 130) of the casing string 28, the plug 80 includes fins 140 that are disposed circumferentially about a base 142 of the plug 80. The fins 140 are configured to engage the inner wall 138 of the casing string 28 and remove the cement. More particularly, lateral sides 144 of the fins 140 engage and abut the inner wall 138 of the casing string 28 as the plug 80 moves along the casing string 28. As the fins 140 pass over the first sensor 102 and the second sensor 104, a pressure drop is measured by the first sensor 102 and the second sensor 104 because spaces 146 between the fins 140 do not include fluid (e.g., cement, water, a water mixture, and/or another chemical substance), and thus, have a reduced pressure when compared to the high-pressure fluid flowing through the casing string 28. For example, the flow of fluid through the casing string 28 includes a relatively high pressure in order to direct the flow of fluid from the rig floor 12 to the wellbore 30. However, the space between the fins 140 of the plug 80 includes ambient air, for example, which includes a relatively low pressure when compared to the flow of fluid in the casing string 28. Therefore, the first sensor 102 and the second sensor 104 experience a pressure drop as the plug 80 travels past the first sensor 102 and the second sensor.

Figure 3:
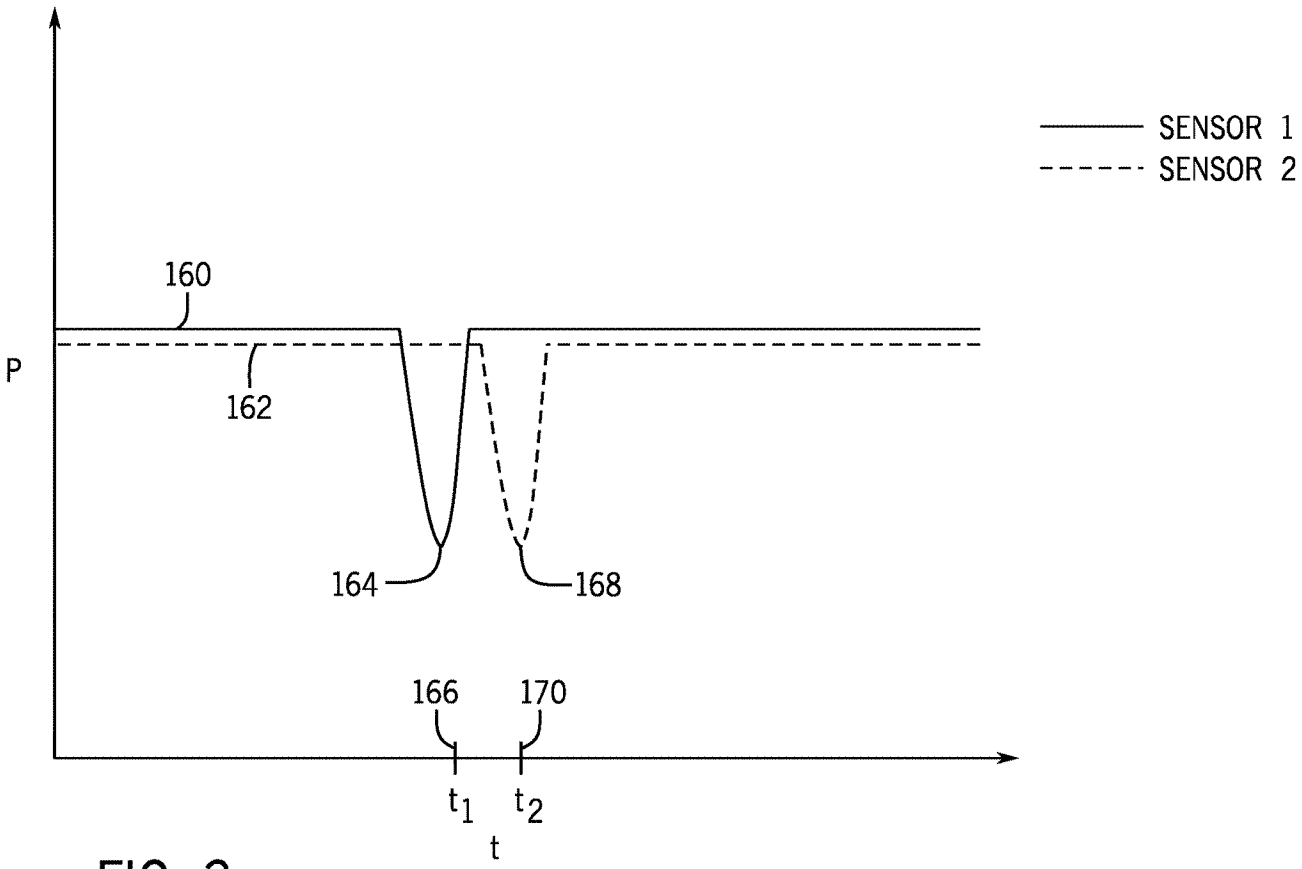
FIG. 3 is a graphical illustration of an embodiment of feedback received from the plug tracking system of FIGS. 1 and 2, in accordance with an aspect of the present disclosure.

FIG. 3 is a graphical illustration of an embodiment of pressure profiles of the first sensor 102 and the second sensor 104 that indicate a launch of the plug 80 (e.g., a successful launch). As shown in the illustrated embodiment of FIG. 3, a first pressure profile 160 corresponds to measurements taken by the first sensor 102 and a second pressure profile 162 corresponds to measurements taken by the second sensor 104. For clarity, the first pressure profile 160 includes a greater pressure than the second pressure profile 162 so that both profiles 160 and 162 are illustrated and may be compared to one another. However, it should be recognized that the first pressure profile 160 and the second pressure profile 162 may have approximately the same pressure measurements (e.g., within 10%, within 5%, or within 1% of one another) over time.

In any case, the first pressure profile 160 corresponding to the first sensor 102 includes a first pressure drop 164 that occurs at a first time 166. The first pressure drop 164 at the first time 166 is indicative of the plug 80 moving past the first sensor 102. Similarly, the second pressure profile 162 corresponding to the second sensor 104 includes a second pressure drop 168 that occurs at a second time 170, which is later than the first time 166. The second pressure drop 168 is indicative of the plug 80 moving past the second sensor 104, which is positioned downstream of the first sensor 102 with respect to the flow of fluid through the casing string 28. As such, the second pressure drop 168 occurs after the first pressure drop 166. The controller 52 may determine that the plug 80 has launched when the feedback from the first sensor 102 and the second sensor 104 includes the first pressure drop 164 and the second pressure drop 168 that occur sequentially (e.g., the first pressure drop 164 measured by the first sensor 102 occurs before the second pressure drop 166 measured by the second sensor 104), and when the difference between the first time 166 and the second time 170 falls within a predetermined elapsed time range. As discussed above, the predetermined elapsed time range may be between 250 milliseconds and 10 seconds, between 500 milliseconds and 5 seconds, or between 750 milliseconds and 2 seconds.

While the illustrated embodiment of FIG. 3 shows the first pressure profile 160 and the second pressure profile 162 having substantially constant pressure measurements except for the first pressure drop 164 and the second pressure drop 168, respectively, the first pressure profile 160 and/or the second pressure profile 164 may include pressure fluctuations over time. For example, as discussed above, pressure fluctuations may be detected by the first sensor 102 and the second sensor 104 as a result of a pump and/or another drive that directs the flow of fluid through the casing string 28 from the rig floor 12 to the wellbore 30. Thus, in other embodiments, the first pressure profile 160 and the second pressure profile 162 may include a sinusoidal curve and/or another suitable shape that includes pressure fluctuations measured by the first sensor 102 and the second sensor 104 over time.

As such, the controller 52 may detect the pressure drops 164 and 168 when the pressures measured by the first sensor 102 and the second sensor 104, respectively, fluctuate by a predetermined amount. For example, the pressure drops 164 and 168 indicative of the plug 80 moving past the sensors 102 and 104, respectively, may be determined when the pressure fluctuates by more than 10%, more than 15%, more than 20%, or more than 25% over a predetermined time interval (e.g., 10 milliseconds, 50 milliseconds, or 100 milliseconds). Pressure fluctuations that do not exceed the predetermined amount may effectively be identified by the controller 52 as fluctuations caused by the pump and/or pressure fluctuations within the wellbore 30.

In some embodiments, when the controller 52 receives the feedback from the first sensor 102 and the second sensor 104 indicative of the launch of the plug 80, the controller 52 may send a signal to a user (e.g., via a user interface) to indicate that the plug 80 has launched into the casing string 28. For example, the user may initiate the launch of the plug (e.g., via the user interface) and subsequently receive an indication (e.g., illumination of a light emitting diode (LED), sounding of a horn, or another suitable audio or visual form of communication from the controller) from an indicator 198 (see, e.g., FIG. 2) of the controller 52 that the launch has occurred. Additionally, the controller 52 may be configured to determine that the launch of the plug 80 has not occurred after a predetermined time. For example, if the user initiates the launch of the plug 80 and the controller 52 does not receive the feedback from the first sensor 102 and the second sensor 104 indicative of the sequential pressure drop within the predetermined elapsed time range, the controller 52 may send a second signal to the user (e.g., via the user interface) indicative of an unsuccessful launch of the plug 80. Accordingly, the user may take action to remove the plug 80 and reattempt to initiate the launch of the plug 80.

Figure 4:
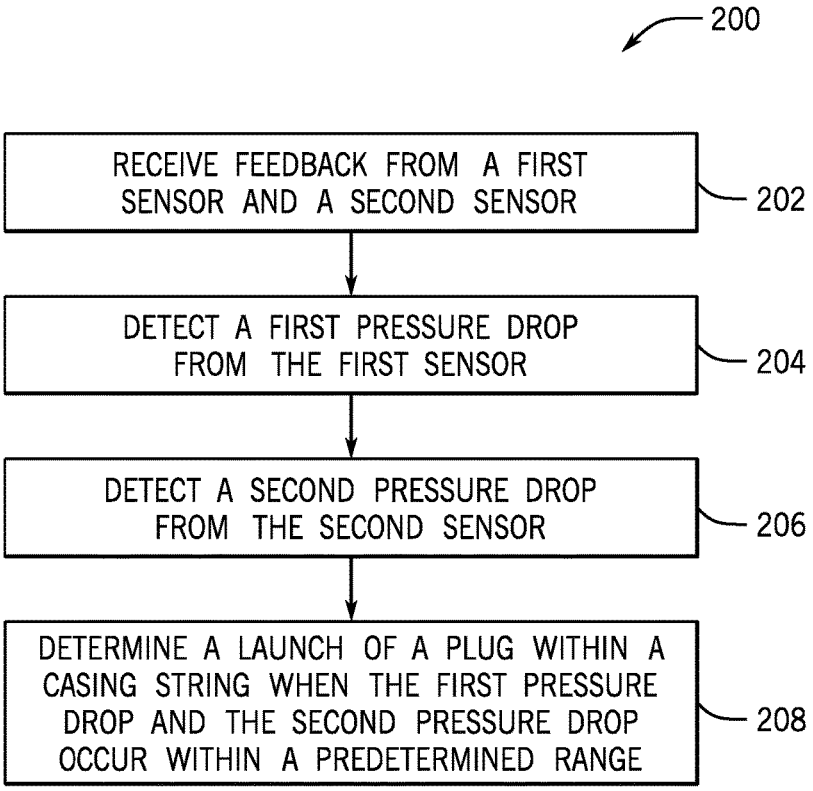
FIG. 4 is a block diagram of an embodiment of a process for employing the plug tracking system of FIGS. 1 and 2, in accordance with an aspect of the present disclosure.

FIG. 4 is a block diagram of an embodiment of a process 200 that may be utilized to detect a launch of the plug 80 using the plug detection system 100. For example, at block 202, the controller 52 receives feedback from the first sensor 102 and the second sensor 104 indicative of the first pressure profile 160 and the second pressure profile 162, respectively. At block 204, the controller 52 may detect the first pressure drop 164 of the first pressure profile 160 as the plug 80 passes the first sensor 102 (e.g., when the pressure fluctuates a predetermined amount over a predetermined time interval). Similarly, the controller 52 detects the second pressure drop 168 of the second pressure profile 162 as the plug 80 passes the second sensor 104, as shown at block 206 (e.g., when the pressure fluctuates a predetermined amount over a predetermined time interval). At block 208, the controller 52 may then determine that the plug 80 has launched when the second pressure drop 168 occurs a predetermined time after the first pressure drop 164. In other words, the controller 52 determines that the plug launches within the casing string 28 when a time difference between the first pressure drop 164 and the second pressure drop 168 is within a predetermined elapsed time range. As discussed above, the predetermined elapsed time range may be between 250 milliseconds and 10 seconds, between 500 milliseconds and 5 seconds, or between 750 milliseconds and 2 seconds.

The controller 52 may also send a signal to the user (e.g., via a user interface) indicating that the plug 80 has launched. Alternatively, if the first pressure drop 164 and the second pressure drop 168 do not occur within the predetermined elapsed time range and/or the first pressure drop 164 and/or the second pressure drop 168 do not occur at all, the controller 52 may send a second signal to the user (e.g., via the user interface) indicating that the plug 80 did not launch.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A cement plug detection system, comprising:
- a cement plug; and
- a sensor system, comprising:
  - a first sensor disposed within a tubular and configured to monitor a pressure within the tubular;
  - a second sensor disposed within the tubular downstream of the first sensor with respect to a flow of fluid through the tubular, wherein the second sensor is configured to monitor the pressure within the tubular; and
  - a controller configured to detect a launch of the cement plug when the first sensor detects a first pressure drop and when the second sensor detects a second pressure drop, wherein the second pressure drop occurs after the first pressure drop within a predetermined elapsed time range.

2. The cement plug detection system of claim 1, wherein the cement plug comprises a length, wherein the first sensor and the second sensor are spaced a distance from one another along the tubular, and wherein the distance is greater than the length.

3. The cement plug detection system of claim 1, wherein the controller is configured to receive feedback from the first sensor indicative of a first pressure profile within the tubular, and wherein the controller is configured to receive feedback from the second sensor indicative of a second pressure profile within the tubular.

4. The cement plug detection system of claim 3, wherein the first pressure profile comprises the first pressure drop and the second pressure profile comprises the second pressure drop.

5. The cement plug detection system of claim 3, wherein the first pressure profile and the second pressure profile comprise pressure fluctuations caused by a pump that is configured to direct the flow of fluid through the tubular.

6. The cement plug detection system of claim 1, comprising the tubular, wherein the tubular comprises an extension portion, and wherein the first sensor or the second sensor is disposed within the extension portion, such that a flow rate of the flow of fluid through the tubular may be determined.

7. The cement plug detection system of claim 1, wherein the controller is configured to send a signal to provide an indication to a user upon detection of the launch of the cement plug.

8. The cement plug detection system of claim 7, wherein the indication comprises illumination of a light emitting diode, sounding of a horn, or another audio or visual alert to the user.

9. The cement plug detection system of claim 1, wherein the first sensor and the second sensor comprise pressure transducers.

10. A drilling system, comprising:
- a casing string configured to receive and direct drilling fluids from a rig floor to a wellbore;
- a cement swivel configured to supply cement into the casing string to secure the casing string in the wellbore;
- a cement plug configured to remove cement from within the casing string; and
- a sensor system, comprising:
  - a first sensor disposed within the casing string and configured to monitor a pressure within the casing string;
  - a second sensor disposed within the casing string downstream of the first sensor with respect to a flow of drilling fluid through the casing string, wherein the second sensor is configured to monitor the pressure within the casing string; and a controller configured to detect a launch of the cement plug when the first sensor detects a first pressure drop and when the second sensor detects a second pressure drop, wherein the second pressure drop occurs after the first pressure drop within a predetermined elapsed time range.

11. The system of claim 10, wherein the casing string comprises a first opening configured to receive the first sensor and a second opening configured to receive the second sensor.

12. The system of claim 11, wherein the cement plug comprises a length, wherein the first opening and the second opening are spaced a distance from one another, and wherein the distance is greater than the length.

13. The system of claim 11, wherein the first opening and the second opening are sealed after the first sensor and the second sensor are disposed in the first opening and the second opening respectively.

14. The system of claim 13, wherein the first opening and the second opening are sealed using welding, a silicone sealant, an epoxy sealant, or a combination thereof.

15. The system of claim 10, wherein the cement plug comprises fins to facilitate removal of the cement from within the casing string.

16. A method, comprising:

receiving feedback from a first sensor disposed in a casing string and a second sensor disposed in the casing string, wherein the second sensor is positioned downstream of the first sensor with respect to a flow of fluid within the casing string;

detecting a first pressure drop from the first sensor;

detecting a second pressure drop from the second sensor; and determining a launch of a cement plug in the casing string when the first pressure drop and the second pressure drop occur within a predetermined elapsed time range.

17. The method of claim 16, comprising initiating the launch of the cement plug into the casing string after completing a casing cementing process.

18. The method of claim 16, wherein receiving the feedback from the first sensor and the second sensor comprises receiving a first pressure profile from the first sensor and receiving a second pressure profile from the second sensor.

19. The method of claim 18, wherein detecting the first pressure drop comprises detecting a first pressure fluctuation of the first pressure profile that exceeds a predetermined amount, and wherein detecting the second pressure drop comprises detecting a second pressure fluctuation of the second pressure profile that exceeds the predetermined amount.

20. The method of claim 16, comprising sending a signal to provide an indication that the launch of the cement plug occurred when the first pressure drop and the second pressure drop occur within the predetermined elapsed time range, and wherein the indication comprises illuminating a light-emitting-diode, sounding a horn, or actuating another audio or visual indicator to alert a user that the launch of the cement plug occurred.

* * * * *